United States Patent [19]

Wilson

[11] Patent Number: 4,627,246

[45] Date of Patent: Dec. 9, 1986

[54] REFRIGERATOR COMPARTMENT PARTITION AND METHOD OF ASSEMBLY

[75] Inventor: Arthur C. Wilson, Louisville, Ky.

[73] Assignee: General Electric, Louisville, Ky.

[21] Appl. No.: 627,199

[22] Filed: Jul. 2, 1984

[51] Int. Cl.[4] ..... F25D 21/14

[52] U.S. Cl. ..... 62/286; 62/285; 312/129

[58] Field of Search ..... 62/288, 246, 247, 285, 62/286; 312/116, 117, 118, 119, 122, 129

[56] References Cited

U.S. PATENT DOCUMENTS

| | | | |
|---|---|---|---|
| 2,192,562 | 3/1940 | Scott | 62/89 |
| 2,501,540 | 3/1950 | Ryan | 312/171 |
| 2,509,610 | 5/1950 | Philipp | 62/103 |
| 2,593,305 | 4/1952 | Hunter | 296/44 |
| 2,633,003 | 3/1953 | Jordan | 62/4 |
| 2,682,754 | 7/1954 | Eck | 62/89 |
| 2,725,271 | 11/1955 | Cunningham | 312/214 |
| 3,429,628 | 2/1969 | Laszlo | 312/214 |
| 3,601,463 | 8/1971 | Watt | 312/214 |
| 4,191,434 | 3/1980 | Powell et al. | 312/214 |

*Primary Examiner*—Henry Bennett
*Attorney, Agent, or Firm*—Frederick P. Weidner; Radford M. Reams

[57] ABSTRACT

Compartment partition assembly and method for a refrigerator cabinet of the type having an outer shell, an inner liner with a rear wall and side walls and a partition separating the freezer and fresh food compartments. There is provided a channel having a bottom and upper and lower side walls formed on each of the side walls of the refrigerator liner. An insulating member is formed having a top, bottom, side, front and rear walls, the bottom wall of which overlies a plate defining a surface of the fresh food compartment. The top wall of the insulating member is formed to provide a drain and sealing system having troughs with exterior walls along the periphery of the top wall adjacent the side and rear walls of the insulating member and deflected inwardly by the rear wall of the liner and the upper side walls of the liner channels. This compartment partition assembly prevents any gaps or thermal leakage and provides a drain system for defrosting the freezer compartment.

8 Claims, 7 Drawing Figures

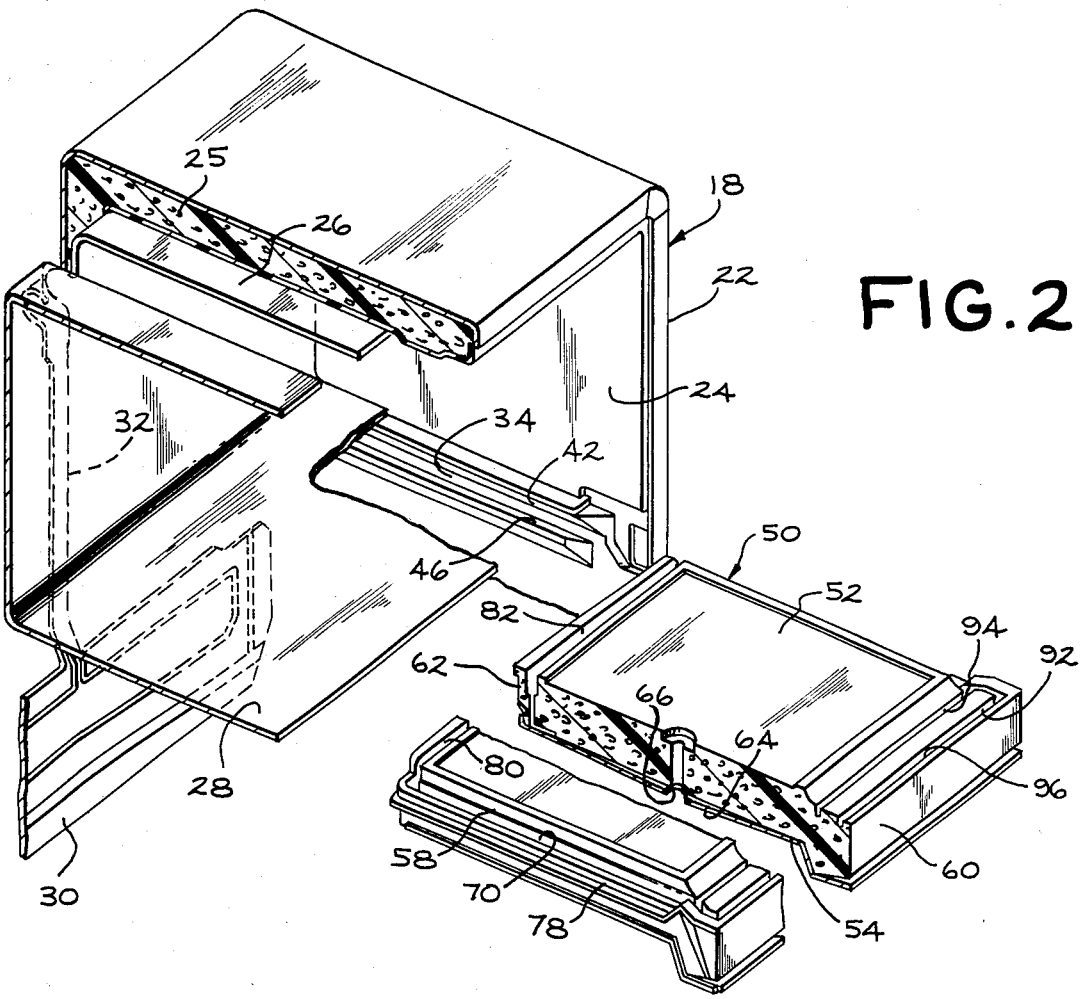
FIG. 2
FIG. 5
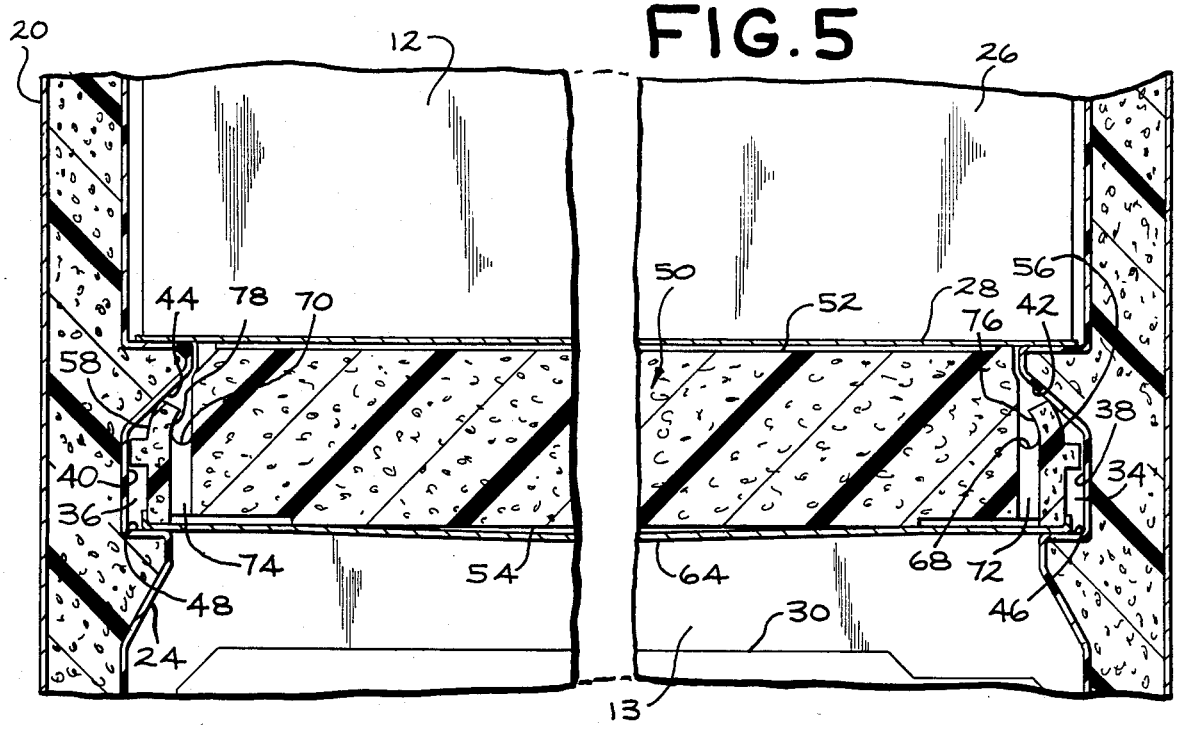

REFRIGERATOR COMPARTMENT PARTITION AND METHOD OF ASSEMBLY

BACKGROUND OF THE INVENTION

In the construction of a household refrigerator, it is often desirable to provide a partition within the refrigerator for separating the refrigerator into first and second compartments such as a freezer compartment and a fresh food compartment, for example. This invention relates generally to the compartment partition assembly and method and more specifically to means for providing improved thermal separation between the compartments in a refrigerator. The invention also relates to preventing air leakage gaps from developing between the partition and the liner of the refrigerator which are occasioned by the thermal variations of refrigerator operation or reasonable manufacturing dimensional variations. The invention also relates to providing a defrost drain system in the partition that allows a refrigerator having the evaporator in the freezer compartment to be defrosted and the liquid resulting from the defrost operation may be easily and effectively removed from the refrigerator.

SUMMARY OF THE INVENTION

A compartment partition assembly and method for a refrigerator cabinet of the type having an outer shell, an inner liner with a rear wall and side walls and a partition separating the freezer and fresh food compartments. A channel is formed having a bottom and upper and lower side walls on each of the side walls of the inner liner. An insulating member which is a thermal compartment divider is formed to have a top, bottom, side, front and rear walls, the bottom wall of which overlies a plate which defines the top wall of the fresh food compartment. The top wall of the insulating member is formed to provide a drain and sealing system having troughs with exterior walls along the periphery of the top wall adjacent the side and rear walls of the insulating member and deflected inwardly by the rear wall of the liner and upper side walls of the liner channels. With this arrangement the compartment partition assembly is firmly and rigidly secured to the inner liner to prevent any gaps or thermal leakage. For those refrigerators that have the evaporator in the freezer compartment there is also provided a drain system for liquids to flow as a result of defrosting of the evaporator and remove the liquid from the refrigerator.

BRIEF DESCRIPTION OF THE DRAWINGS

FIG. 2 is an exploded perspective view showing the components of the refrigerator used in connection with assembling the refrigerator compartment partition in accordance with the present invention.

FIG. 5 is a cross-sectional view of the side portions of the refrigerator and the compartment partition assembly after completion of installation in the refrigerator according to the present invention.

DESCRIPTION OF THE PREFERRED EMBODIMENT

Figure 1:
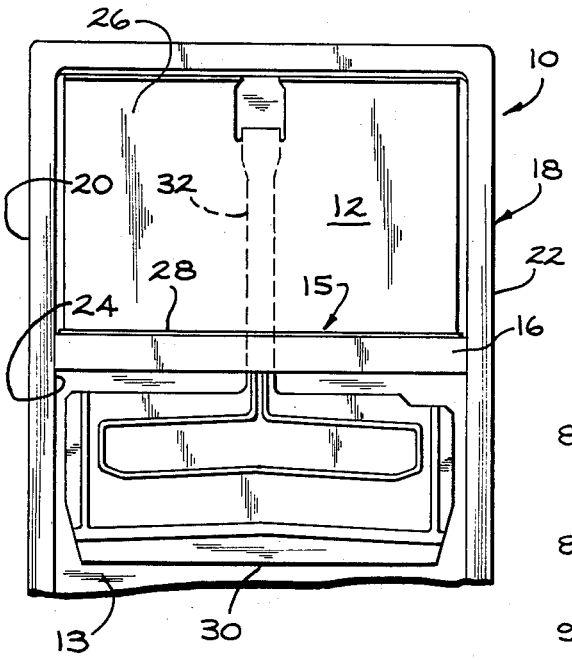
FIG. 1 is a front elevational view of a portion of a top mount refrigerator showing both the fresh food compartment below and the freezer compartment above and showing the compartment partition assembly location between those compartments.

Referring to FIGS. 1 and 2, a refrigerator 10 such as a top mount household refrigerator, for example, has a freezing compartment 12, and a fresh food compartment 13 separated by a compartment partition assembly 15 having a forwardly positioned or front face mullion component 16. Upon completion of the assembly of the refrigerator, the freezer compartment and fresh food compartment would have separate doors (not shown) for closing the respective compartments. The refrigerator 10 has a cabinet outer metal case or shell 18 that has opposite side walls 20 and 22 which envelops both the freezer and fresh food compartments. The outer metal shell 18 has an inner liner 24 which is made of sheet metal or plastic material. As shown in FIG. 2, between the inner liner 24 and outer metal shell 18 there is insulation 25.

In the preferred embodiment of the top mount refrigerator shown in FIGS. 1 and 2 there is a sheet metal evaporator 26 which is shaped to fit into the freezer compartment 12 and has one portion 28 forming the bottom wall of the freezer compartment 12 which is disposed above the top of the compartment partition assembly 15. A second portion 30 of the evaporator extends downwardly into the fresh food compartment 13 with a third narrow portion 32 interconnecting the first portion 28 and the second portion 30 of the evaporator. The second portion 30 of the evaporator is smaller in capacity relative to the first portion of the evaporator in the freezer and is utilized to aaintain the fresh food compartment at a proper above freezing temperature.

With reference to FIG. 2 the components and their arrangement and their method of assembly of the compartment partition assembly will be discussed. The inner liner 24 is usually made of sheet metal or plastic material and has formed channels 34 and 36, one in each side of the inner liner 24. Channels 34 and 36 each have a bottom wall 38 and 40 respectively, an upper side wall 42 and 44 respectively and a lower side wall 46 and 48 respectively. The upper side walls 42 and 44 of the liner channels 34 and 36 respectively are at an angle relative to the bottom walls 38 and 40 and diverge away from the lower side walls 46 and 48 respectively. The channels 34 and 36 are usually molded in place when the inner liner 24 is formed from plastic material. These channels are dimensioned to receive the compartment partition separating the freezer compartment 12 from the fresh food compartment 13.

The compartment partition assembly includes an insulating member 50 forming a thermal compartment divider having top wall 52, bottom wall 54, side walls 56 and 58, front wall 60 and rear wall 62. Underlying the bottom wall 54 of the insulating member 50 is a plate 64 which defines the top wall of the fresh food compartment 13. The plate 64 as best seen in FIG. 5 is shaped to have an incline downwardly from the outer edges thereof to the center of the plate. At the center of the plate 64 there is an opening 66 the purpose of which will be described later.

Figure 3:
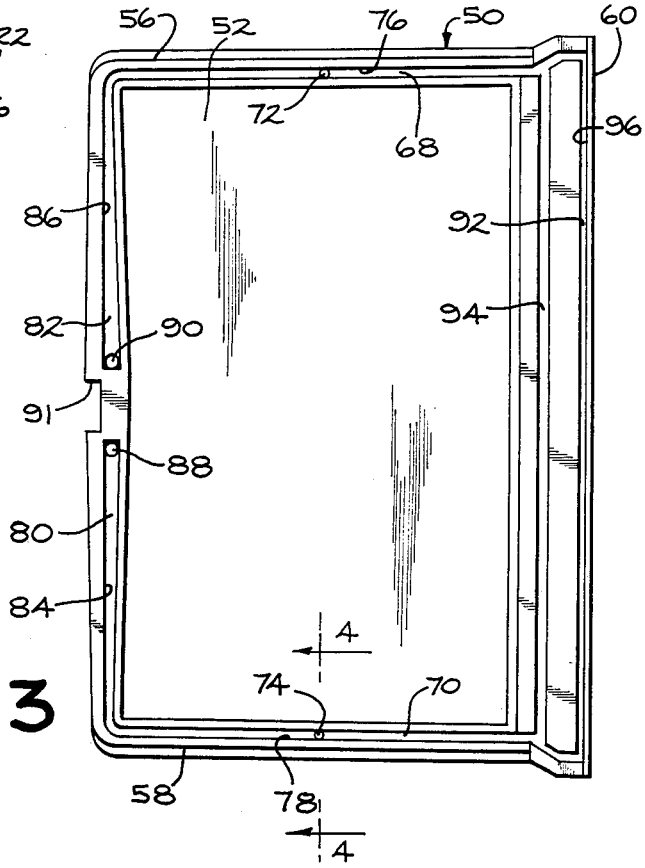
FIG. 3 is a top plan view of the insulating member utilized in the compartment partition assembly of the present invention.

In the preferred embodiment the insulating member 50 is formed from styrofoam plastic or other insulating media with some resiliency and is provided with a drain system as best seen in FIG. 3. The drain system has troughs on the top wall 52 formed along the periphery thereof and includes side troughs 68 and 70 each having a drain opening 72 and 74 respectively through the insulating member. These side troughs 68 and 70 have their exterior walls 76 and 78 respectively along the periphery of the top wall 52 adjacent the side walls 56 and 58. The rear of the insulating member has a trough 80 and 82 with exterior walls 84 and 86 respectively along the periphery of the top wall 52 adjacent the rear wall 62. In the preferred embodiment troughs 80 and 82 are inclined downwardly toward each other and have drain openings 88 and 90 respectively through the insulating member and located in the lowest end of each of the respective troughs 80 and 82. The troughs 80 and 82 are separated by a recess 91 in the rear wall 62 of the insulating member 50. The front of the insulating member 50 also has a trough 92 and a second trough 94 behind trough 92 if desired. The trough 92 has an exterior wall 96 along the periphery of the top wall 52 adjacent the front wall 60 of the insulating member 50. Troughs 92 and 94 are formed so that liquid may drain into the side troughs 68 and 70. It will be noted particularly in FIG. 3 that the front trough 92 and also the second front trough 94 are in liquid flow communication with the side troughs 68 and 70 and the rear troughs 80 and 82 are also in liquid flow communication with the side troughs 68 and 70. Thus the insulating aember 50 in the preferred embodiment is provided with a surrounding drain system that will allow liquid to pass through the drain openings in the various troughs down onto the plate 64. There are, of course, other drain means that could be provided to remove liquid from the insulating member 50 drain system.

Figure 4:
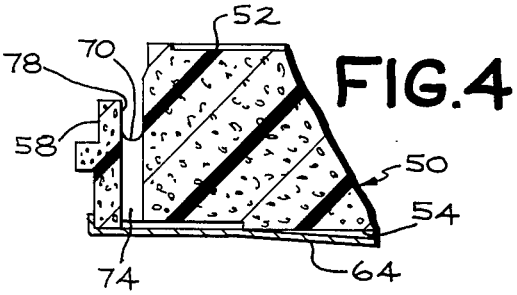
FIG. 4 a view taken along lines 4—4 of FIG. 3 showing a portion of the components and their arrangement prior to assembly of the compartment partition in the refrigerator.

As mentioned previously the evaporator 26 is formed and received in the refrigerator freezer compartment 12 and one portion of the evaporator 28 forms the bottom wall of the freezer compartment. In assembling the compartment partition assembly the insulating member 50 and the plate 64 are sandwiched together as shown in FIG. 2 and inserted into the channels 34 and 36 of the side walls of the liner 24. The exterior walls 76 and 78 of the side troughs 68 and 70 are dimensioned to be a slightly greater distance apart than the distance between the upper walls 42 and 44 of the channels 34 and 36 so that upon forcing the insulating member 50 inwardly the exterior walls 76 and 78 are deflected inwardly. The deflection of the side trough exterior walls 76 and 78 are from that as shown in FIG. 4 to the completed assembly shown in FIG. 5 assures a snug fit of the compartment partition assembly to the inner liner 24 so that there is good thermal insulation sealing with minimum thermal leakage between the freezer compartment and fresh food compartment. Moreover, as can be seen in FIG. 5 the troughs still provide a liquid drain system that will drain liquid during the refrigerator defrost operation.

Figure 6:
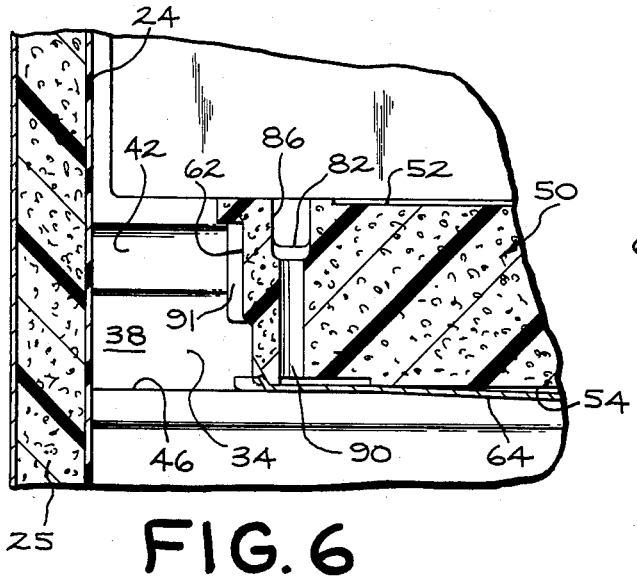
FIG. 6 is a fragmented, cross-sectional view of a rear portion of the compartment partition assembly showing components of the assembly prior to completion of installation of the compartment partition assembly in the refrigerator according to the present invention.
Figure 7:
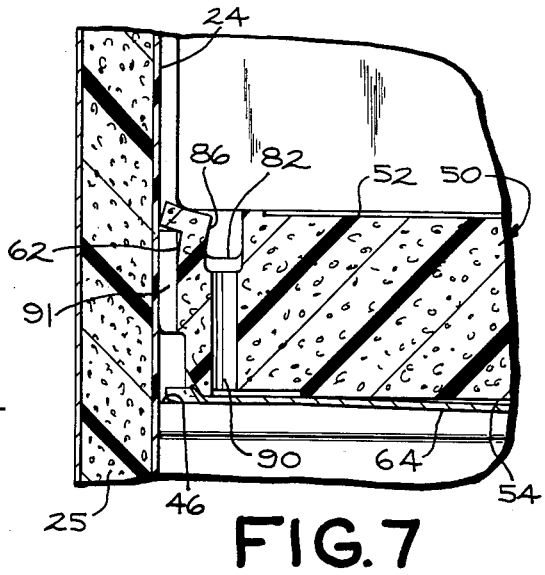
FIG. 7 is similar to FIG. 6 and shows the rear portion of the compartment partition assembly after complete installation in the refrigerator cabinet according to the present invention.

FIG. 6 shows the rear trough 80 and 82 configuration during partial assembly of the compartment partition and the completed assembly is shown in FIG. 7 wherein the insulating member 50 abuts the rear wall of the freezer compartment and deflects inwardly the exterior wall 84 and 86 to again provide good thermal insulation sealing qualities with minimum thermal leakage between the freezer and fresh food compartments and also provides for the trough to be part of the liquid drain system during the defrost operation.

The compartment partition assembly normally has some additional mullion components in front of the front wall 60 and which is then faced for appearance purposes with a front face mullion component 16.

By this component partition assembly arrangement and method of assembling there is provided a liquid drain system so that upon defrosting the evaporator 26 the resultant liquid will flow into the troughs of the drain system around the periphery of the top wall 52 of insulating member 50 and pass through the drain openings in those troughs downwardly into the top of plate 64. As discussed above, the plate 64 is slanted from the peripheral edges thereof toward the center as most clearly seen in FIG. 5 where there is a drain opening 66 which will permit the person defrosting the refrigerator to catch the defrost liquid in a pan for removal from the refrigerator.

While the specific embodiment and method of this invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. Compartment partition assembly for a refrigerator cabinet of the type having an outer shell, an inner liner with a rear wall and side walls and a partition separating the freezer and fresh food compartments comprising:

a sheet metal evaporator in the freezer compartment with one portion forming the bottom wall of the freezer compartment and a portion of the evaporator extends downwardly into the fresh food compartment, a channel having a bottom and upper and lower side walls formed on each of the side walls of the liner, a plate defining the top wall of the fresh food compartment, and an insulating member forming a thermal compartment divider under the bottom wall of the freezer compartment and having top, bottom, side, front and rear walls, the bottom wall of which overlies said plate, said top wall formed to provide a drain and sealing system having troughs with exterior walls along the periphery of the top wall adjacent the side and rear walls of the insulating member and deflected inwardly by the rear wall of the liner and upper side walls of the liner channels, said top wall having two troughs with exterior walls along the periphery of the top wall adjacent the rear wall of the insulating member and they are spaced apart to accommodate the evaporator portion extending from the freezer into the fresh food compartment and the two troughs are inclined downwardly toward each other and there are drain openings through the insulating member at the lowest end of each of the respective troughs.

2. The compartment partition assembly of claim 1 wherein the drain and sealing system has an opening in liquid flow communication with the plate.

3. The compartment partition assembly of claim 1 wherein the drain and sealing system includes a trough along the periphery of the top wall with an exterior wall adjacent the front wall of the insulating member.

4. The compartment partition of claim 3 wherein the trough along the periphery of the top wall with an exterior wall adjacent the front wall of the insulating member is in liquid flow communication with the troughs having exterior walls along the periphery of the top wall adjacent the side walls.

5. The compartment partition assembly of claim 1 wherein the upper side wall of the liner channels is at an angle relative to the bottom wall and diverges away from the lower side wall.

6. The compartment partition assembly of claim 1 wherein the drain and sealing system directs liquid to the underlying plate and the plate has an opening through which the liquid may drain.

7. The compartment partition assembly of claim 1 wherein the insulating member is formed from insulating media with some resiliency.

8. The compartment partition assembly of claim 1 wherein the two troughs adjacent the rear wall of the insulating member are elevated relative to the troughs adjacent the side walls of the insulating member and the troughs adjacent the side walls are in liquid flow communication with the troughs adjacent the rear wall of the insulating member.

* * * * *